US012018863B1

(12) United States Patent
Suryanarayana et al.

(10) Patent No.: US 12,018,863 B1
(45) Date of Patent: Jun. 25, 2024

(54) SYSTEMS, PROCESSES, AND MODELING METHODS FOR DRILLING IN HOT DRY ROCK USING SUPERCRITICAL OR DENSE PHASE CARBON DIOXIDE

(71) Applicant: .BLADE ENERGY PARTNERS, LTD., Frisco, TX (US)

(72) Inventors: Poodi Peddi Suryanarayana, Plano, TX (US); Natalia Romero Jaimes, Houston, TX (US); Sharat V. Chandrasekhar, Dallas, TX (US); Romar Alexandra Gonzalez-Luis, Aubrey, TX (US); Oscar R. Gabaldon, Frisco, TX (US); Robert M. Pilko, Houston, TX (US)

(73) Assignee: BLADE ENERGY PARTNERS LTD., Frisco, TX (US)

( * ) Notice: Subject to any disclaimer, the term of this patent is extended or adjusted under 35 U.S.C. 154(b) by 0 days.

(21) Appl. No.: 18/508,834

(22) Filed: Nov. 14, 2023

Related U.S. Application Data

(60) Provisional application No. 63/584,809, filed on Sep. 22, 2023.

(51) Int. Cl.

| | |
|---|---|
| ***E21B 36/00*** | (2006.01) |
| ***E21B 44/00*** | (2006.01) |
| ***E21B 47/017*** | (2012.01) |
| ***F24T 10/10*** | (2018.01) |
| *E21B 21/14* | (2006.01) |
| *F24T 10/00* | (2018.01) |

(52) U.S. Cl.
CPC ..... *F24T 10/10* (2018.05); *E21B 36/001* (2013.01); *E21B 44/00* (2013.01); *E21B 21/14* (2013.01); *E21B 47/0175* (2020.05); *F24T 2010/56* (2018.05)

(58) Field of Classification Search
CPC ..... E21B 21/14; E21B 21/16; E21B 36/001; E21B 41/0064; E21B 47/0175
See application file for complete search history.

(56) References Cited

U.S. PATENT DOCUMENTS

| | | | |
|---|---|---|---|
| 3,650,337 | A | 3/1972 | Andrews et al. |
| 6,347,675 | B1 | 2/2002 | Kolle |
| 9,074,794 | B2 | 7/2015 | Suryanarayana et al. |
| 9,703,904 | B2 | 7/2017 | Suryanarayana et al. |
| 9,803,626 | B1 | 10/2017 | Eastman et a. |
| 11,634,986 | B2 | 4/2023 | Hu et al. |
| 2009/0126923 | A1 | 5/2009 | Montgomery et al. |
| 2010/0200237 | A1 | 8/2010 | Colgate et al. |

(Continued)

FOREIGN PATENT DOCUMENTS

WO WO 2012/173916 12/2012

OTHER PUBLICATIONS

United States Department of Energy, "What is an Enhanced Geothermal System (EGS)?"; Sep. 24, 2012, pp. 1-2.

(Continued)

*Primary Examiner* — Robert E Fuller
*Assistant Examiner* — Lamia Quaim
(74) *Attorney, Agent, or Firm* — Jeffrey L. Wendt; THE WENDT FIRM, P.C.

(57) ABSTRACT

Systems and processes for dry hot rock drilling operations using $sCO_2$ expanded across one or more downhole J-T valves or chokes to cool MWD components. Methods of modeling same.

12 Claims, 10 Drawing Sheets

(56) References Cited

U.S. PATENT DOCUMENTS

| | | | | |
|---|---|---|---|---|
| 2012/0312545 | A1 | 12/2012 | Suryanarayana et al. | |
| 2014/0190701 | A1 | 7/2014 | Humphreys | |
| 2023/0114197 | A1 * | 4/2023 | Hughes | E21B 41/0064 165/45 |

OTHER PUBLICATIONS

Leuchenberg et al., "Development and Performance of Surface Equipment for High Temperature Underbalanced Drilling in Sour, Severely Under Pressured Formation", Mobil Oil (2004) pp. 1-10.
Erkan, K et al., "Understanding the Chena Hot Springs, Alaska", *Geothermics 37 (2008) 565-585*.
Muir, J. R., "New Opportunities and Applications for Closed-Loop Geothermal Energy Systems", Geothermal Rising Bulletin, Dec. 2020, vol. 49, No. 4, pp. 12-16.

* cited by examiner

| Drilling Fluid | Carbon dioxide | | | |
|---|---|---|---|---|
| | Metric | | USC | |
| Entity | Units | Value | Units | Value |
| DrillPipe ID | m | 0.108 | in | 4.260 |
| DrillPipe OD | m | 0.127 | in | 5.000 |
| Hole Dia | m | 0.216 | in | 8.500 |
| Mass Flow Rate | Kg/s | 20 | lb/hr | 158,400 |
| Annulus Return Pressure | Mpa | 3.447 | Psi | 500 |
| Inlet Temperature | C | 50 | F | 122 |
| Hole Length | m | 3,048 | ft | 10,000 |
| Cased Hole Roughness | mm | 0.0508 | in. | 0.002 |
| Open Hole Roughness | mm | 0.0750 | in. | 0.002 |
| Drillpipe Thermal Conductivity | W/m-K | 10 | BTU/ft-hr-F | 5.8 |

Formation Properties

| | | |
|---|---|---|
| Surface Geothermal Temperature | C | 21 |
| Geothermal Gradient | C/m | 0.1325 |
| Thermal Conductivity | W/m-K | 2 |
| Specific Heat | J/kg-K | 2500 |
| Density | $Kg/m^3$ | 2243 |
| Thermal Diffusivity | $m^2/s$ | 3.57E-07 |
| Drilling Duration | hours | 96 |
| Fourier Number | n/a | 2.64E+00 |
| Ramey/Jessop Function | n/a | 1.124 |

Chokes (2nd column blank for no choke)

| Depth (m) | Orif Dia (mm) | Discontinuity at Choke Pres.(Psi) | Discontinuity at Choke Temp. (°C) |
|---|---|---|---|
| | | 0 | 0 |
| | | 0 | 0 |
| 2,900 | 12 | -7,403 | -54 |

| | |
|---|---|
| MWD Depth | 2,850 |
| Max # Iterations | 500 |
| Convergence Criterion | 1E-01 |
| Reset Initial Condition? | NO |

Nozzle Dia. (1/32 in.)

| | |
|---|---|
| 1 | 16 |
| 2 | 16 |
| 3 | 16 |

Nozzle Pressure Drop across Bit (Psi) -477

FIG. 3

12mm Choke with 25kg/s Case Results

Chokes (2nd column blank for no choke)

| Depth (m) | Orif Dia (mm) | Discontinuity at Choke | |
|---|---|---|---|
| | | Pres. (psi) | Temp. (°C) |
| | | 0 | 0 |
| | | 0 | 0 |
| 2,900 | 12 | -9,229 | -7 |

| | |
|---|---|
| 2,850 | |
| 500 | |
| 1E-02 | |
| NO | |

Nozzle Dia. (1/32 in.)

| | |
|---|---|
| 1 | 16 |
| 2 | 16 |
| 3 | 16 |

Nozzle Pressure Drop across Bit (psi) -400

RUN

| | Temperature (°C) | | |
|---|---|---|---|
| | D/P | ANN | Geo |
| Surface | 50.0 | 44.5 | 21.0 |
| MWD | 45.8 | 42.2 | 408.7 |
| Drillbit | 39.5 | 36.4 | 424.9 |

| | Pressure | | | |
|---|---|---|---|---|
| | Drillpipe | | Annulus | |
| | psi | Mpa | psi | Mpa |
| Surface/Standpipe | 7,632 | 52.62 | 501 | 3.45 |
| Drillbit | 2,204 | 15.19 | 1,764 | 12.16 |
| Annulus Surface Pressure Error (psi) | | | 1.0 | |

FIG. 6A

SYSTEMS, PROCESSES, AND MODELING METHODS FOR DRILLING IN HOT DRY ROCK USING SUPERCRITICAL OR DENSE PHASE CARBON DIOXIDE

CROSS-REFERENCE TO RELATED APPLICATIONS

This application is entitled to and claims the benefit of earlier filed provisional application No. 63/584,809, filed Sep. 22, 2023, under 35 U.S.C. § 119(e), which earlier filed provisional application is incorporated by reference herein in its entirety.

BACKGROUND INFORMATION

Technical Field

The present disclosure relates to systems and processes for use of supercritical carbon dioxide (sCO2) and downhole chokes to manage the temperature downhole for the purposes of 1) managing operation of measurement-while-drilling (MWD) equipment, and 2) managing temperature of the return flow. The present disclosure also relates to systems and processes for use of supercritical carbon dioxide (sCO2) and downhole chokes allowing mud pulse telemetry and creating underbalanced drilling conditions in the annulus.

Background Art

A naturally occurring geothermal system, known as a hydrothermal system, is defined by three key elements: heat, fluid, and permeability at depth. An Enhanced Geothermal System (EGS) is a man-made reservoir, created where there is hot rock but insufficient or little natural permeability or fluid saturation. In an EGS, fluid is injected into the subsurface under carefully controlled conditions, which cause pre-existing fractures to re-open, creating permeability. *What is an Enhanced Geothermal System* (*EGS*)? U. S. Dept. of Energy, DOE/EE-0785, September 2012. A different approach, closed-loop geothermal systems (CLGS), overcomes permeability issues by circulating a working fluid through a sealed downhole heat exchanger to absorb and transport heat. CLGS is a versatile technology that can be implemented in a wide variety of different well pipe configurations using a choice of working fluids (such as water and sCO2) to optimize site specific costs and performance. Muir, *New Opportunities and Applications for Closed-Loop Geothermal Energy Systems*, Geothermal Rising Bulletin, December 2020, Vol. 49, No. 4.

Extraction of heat from Dry Hot Rock (DHR) presents several efficiency and power advantages over other EGS or CLGS approaches for geothermal energy recovery. To efficiently extract DHR heat, horizontal wells are drilled within the resource. However, DHR temperatures (>350° C.) are too high for the use of MWD or directional tools. At current state-of-the-art, MWD and directional tools are limited to about 150° C. (limiting the maximum resource temperature to ~200° C.). This restricts DHR drilling to vertical or uncontrolled deviated wells, with single shot surveys to guide directional control. In DHR wells where well trajectory control is critical to connect injector and producer fractures, this can pose a significant problem.

Industry is pursuing different approaches to address this problem. One approach teaches use of vacuum insulated drillpipe: this reduces heat transfer to the drilling fluid, keeping the temperature low. Challenges include handling and maintenance of vacuum. Others approach the problem by increasing the temperature limit of MWD components: companies continue to push the temperature limit of MWD components. These technologies will take some time to become available, and those who may use or recommend these technologies to end users have no direct control over their development and timely availability.

U.S. Pat. No. 6,347,675 discloses a method for increasing the efficiency of drilling operations using by reducing mechanical drilling forces, to remove cuttings, or to jet erode a substrate. In one embodiment, carbon dioxide ($CO_2$) is used as the material for drilling within wells in the earth, where the normal temperature and pressure conditions cause $CO_2$ to exist as a supercritical fluid. The '675 patent discloses use of a choke manifold at the well head or mud cap drilling equipment to control the pressure within the borehole, to ensure that the temperature and pressure conditions necessary for $CO_2$ to exist as either a supercritical fluid or a dense gas occur at the drill site. The '675 patent does not mention MWD, or "measurement", or "modeling". It does speak of using a pressure sensor, but this is not used for directional drilling. The '675 patent speaks of using a surface choke manifold, but does not discuss downhole chokes, as taught by the present disclosure.

As may be seen, current practices may not be adequate for all circumstances, and do not address problems with respect to MWD components and methods when drilling in DHR. There remains a need for more robust DHR drilling systems and processes. The systems and processes of the present disclosure are directed to these needs.

SUMMARY

In accordance with the present disclosure, systems and processes are described which reduce or overcome many of the faults of previously known systems and processes.

A first aspect of the disclosure is a system for well trajectory control in DHR wells to connect injector and producer fractures comprising:

(a) a cased portion of a well configured to accept a drillstring, the drillstring comprising a surface inlet;

(b) a closed-loop $CO_2$ recycle system comprising (i) a well returns conduit, (ii) a $CO_2$ compressor, (iii) a supercritical $CO_2$ pump, the $CO_2$ compressor configured to produce supercritical $CO_2$ and deliver it via the supercritical $CO_2$ pump to the surface inlet at a rate ranging from about 20 to about 25 kg/s (about 300 to about 400 gpm) at a pressure ranging from about 5,000 to about 7,500 psi, and the $CO_2$ compressor configured to accept a return $CO_2$ gas composition at a return pressure of at most 500 psi;

(iv) one or more pressure control devices (for example, but not limited to, one or more chokes) to manage pressure of the closed-loop $CO_2$ recycle system;

(v) one or more gas/solid separators (for example, but not limited to, one or more cyclones, one or more filters, and combinations of these) receiving well returns through the well returns conduit, the one or more gas/solid separators configured to remove a major portion of drill cuttings and solids fines from the well returns and produce the return $CO_2$ gas composition;

(c) the drillstring comprising at least one MWD component protected from malfunctioning by a cooling device (for example, but not limited to, a pressure letdown valve, a choke, and a Joule-Thomson valve), the cooling device configured to accept $sCO_2$ and expel non-critical $CO_2$ adjacent or nearly adjacent the at least one MWD component, thereby cooling the at least one MWD component by Joule-Thomson effect cooling.

Certain system embodiments may comprise one or more dehydrators positioned in the well returns conduit if water influx is a problem. Certain systems may include a rotating control device (RCD) or non-rotating control device (NRCD) at the surface inlet. In certain systems the drillstring may include one or more temperature-sensitive MWD components, and the $sCO_2$ is used in dry hot rock drilling to achieve lower temperatures for MWD operability. In drilling systems, an annulus is created between the drillstring and a borehole, and between the drillstring and the cased wellbore sections. Certain system embodiments may include one or more downhole drillpipe chokes to create a pressure drop and cool down drilling fluid below 150° C. across the one or more temperature-sensitive MWD components, and/or across directional tools. Certain embodiments may have a certain number of downhole chokes to manage conditions to create gaseous phase $CO_2$ in the annulus, and/or maintain annulus temperature at the surface below about 100° C., or below about 90° C., or below about 80° C., or below about 70° C. for ease of handling and RCD/NRCD operability. In certain embodiments the $CO_2$ pump may be configured to generate sufficient pressure and flow rate to transport cuttings to surface.

In certain embodiments the systems may comprise one or more components selected from the group consisting of one or more pressure control devices, (also referred to as chokes), one or more mud pumping devices, one or more flow measurement devices, one or more accessory equipment, and combinations thereof. In certain embodiments the one or more accessory equipment may be selected from the group consisting of one or more connectors, one or more isolation valves, and one or more pressure relief valves. In certain embodiments the one or more components may comprise one or more redundant components in the system. Certain system embodiments may comprise one or more quick connect/quick disconnect connectors.

A second aspect of the disclosure is a process for well trajectory control in DHR wells to connect injector and producer fractures, comprising:

(a) inserting a drillstring comprising at least one MWD component into a cased portion of a well, the drillstring comprising a surface inlet, the drillstring and cased portion of the well defining a first portion of an annulus;

(b) drilling a borehole with the drillstring while trajectory controlling a drill bit attached to a distal end of the drillstring using at least one of the MWD components, the drillstring and borehole wall defining a second portion of the annulus;

(c) pumping supercritical $CO_2$ ($sCO_2$) into the surface inlet at a rate ranging from about 20 to about 25 kg/s (about 300 to about 400 gpm) at a pressure ranging from about 5,000 to about 7,500 psi;

(d) routing at least some of the sCO2 through a cooling device (for example, but not limited to, a pressure letdown valve, a choke, and a Joule-Thomson valve) positioned adjacent or sufficiently adjacent the at least one MWD component, cooling the at least one MWD component by Joule-Thomson effect cooling, thereby protecting the at least one MWD component from malfunctioning, the cooling device expelling non-critical $CO_2$ into the second portion of the annulus;

(d) routing well returns comprising the non-critical $CO_2$ through the first and second portions of the annulus to a well returns conduit;

(e) routing the wells returns to a $CO_2$ compressor of a closed-loop $CO_2$ recycle system, producing the $sCO_2$, the $CO_2$ compressor accepting a return $CO_2$ gas composition at a return pressure of at most 500 psi (f) routing the $sCO_2$ to a supercritical $CO_2$ pump, the supercritical $CO_2$ pump delivering the $sCO_2$ to the surface inlet;

(g) controlling pressure in the first and second portions of the annulus and in the closed-loop $CO_2$ recycle system using one or more pressure control devices (for example, but not limited to, one or more chokes);

(h) removing a major portion of drill cuttings and solids fines from the well returns using one or more gas/solid separators (for example, but not limited to, one or more cyclones, one or more filters, and combinations of these) receiving the well returns through the well returns conduit, the one or more gas/solid separators producing the return $CO_2$ gas composition.

A third aspect of the disclosure are methods of modeling use of $sCO_2$ in drilling a well in dry hot rock using a drillstring having a drill bit and one or more MWD components, the well having an annulus, the drillstring supported by a derrick having a standpipe, comprising:

(a) inputting a transient pressure-enthalpy formulation for $CO_2$;

(b) inputting thermodynamic properties of fluids comprising $sCO_2$ and mixtures of noncritical $CO_2$ with other well return fluids;

(c) inputting surface back pressure;

(d) computing output plots for temperature, pressure, and specific enthalpy along depth of the well;

(e) computing a state diagram (pressure vs. enthalpy) showing a state path of fluid in drillstring and in the annulus;

(f) estimating at least one of:

(i) temperatures at the one or more MWD components, at the drill bit, and of well returns at surface;

(ii) pressures at the standpipe, the one or more MWD components, and at the drill bit (surface back pressure is given, and a parameter of the problem); and/or (iii) annular velocity of fluid in the annulus.

The term "standpipe" means a rigid metal conduit that provides the high-pressure pathway for drilling fluid to travel approximately one-third of the way up the derrick, where it connects to a flexible high-pressure hose (kelly hose). Many large rigs are fitted with dual standpipes so that downtime is kept to a minimum if one standpipe requires repair.

In certain embodiments a logic device may be provided to control all or portions of the systems and processes of the present disclosure, and the logic device may be configured to be operated and/or viewed from a Human/Machine Interface (HMI) wired or wirelessly connected to the logic device. Certain embodiments may include one or more audio and/or visual warning devices configured to receive communications from the logic device upon the occurrence of a pressure rise (or fall) in a sensed pressure above (or below) a set point pressure, or a change in concentration of one or more sensed concentrations or temperatures, or both, above one or more set points. The occurrence of a change in other measured parameters outside the intended ranges may also be alarmed in certain embodiments. Other measured parameters may include, but are not limited to, liquid or gas flow rate, and liquid density.

Certain system and process embodiments of this disclosure may comprise shutting down one, more than one, or all operational equipment inside and/or outside the drillstring and/or well (for example as dictated by a client, law, or regulation), in certain embodiments at least operational equipment inside the drillstring and/or the closed-loop recycle system, upon the occurrence of the adverse event. As used herein, the term "operational equipment" means equipment defined by the operator or owner of the facility being worked and/or utilized as part of the job as being required to be shut down on the occurrence of an adverse event. "Adverse event" means the presence of well fluids at high-pressure inside the production conduit (piping or tubing) inside the well, and which a pressure management sub-system may be designed to shutoff above a maximum set point pressure. In certain embodiments this may correspond with the detection of pressure by the pressure management sub-system above a maximum set point pressure. "Non-adverse event" or time periods are interchangeable with "safe operating conditions" and "safe working conditions."

Certain system and process embodiments of this disclosure may operate in modes selected from the group consisting of automatic continuous mode, automatic periodic mode, and manual mode. In certain embodiments the one or more operational equipment may be selected from the group consisting of pneumatic, electric, fuel, hydraulic, and combinations thereof.

In certain embodiments, pressure (P), temperature (T), density, and/or mass flow may be sensed inside the drillstring, the annulus, the closed-loop recycle system, or any combination of these. Mass flow sensors may be employed. All combinations of sensing T, P, density, and/or mass flow in the drillstring, in the annulus, in the closed-loop recycle system are disclosed herein and considered within the present disclosure.

As used herein "pressure management sub-system" means a structure including a cabinet, frame, or other structural element supporting (and in some embodiments enclosing) pressure management components and associated components, for example, but not limited to pressure control devices (backpressure valves), pressure relief devices (valves or explosion discs), pipes, conduits, vessels, towers, tanks, mass flow meters, temperature and pressure indicators, heat exchangers, pumps, compressors, and quick connect/quick disconnect (QC/QD) features for connecting and disconnecting choke umbilicals, kill umbilicals, and the like. With respect to "pressure management" and "managed pressure", when referring to a pressure management sub-system, these terms have generally understood meaning in the art (see for example the patent documents and technical articles cited herein, such as US20140190701A1) and the terms connote sufficient structure to persons of ordinary skill in the art. The managed pressure may, in some embodiments, be from about 500 psi to about 10,000 psi or greater; alternatively greater than about 700 psi; alternatively greater than about 800 psi; alternatively greater than about 1,000, or greater than about 2,000 psi, or greater than about 3,000 psi. For example, managed pressures may range from about 2,000 to about 5,000 psi; or from about 2,500 to about 4,500 psi; or from about 3,000 to about 4,000; or from about 2,500 to about 5,000 psi; or from about 2,000 to about 4,500 psi; or from about 2,000 to about 3,000 psi; or from about 4,000 to about 5,000 psi; or from about 3,000 to about 10,000 psi; or from about 4,000 to about 8,000 psi; or from about 5,000 to about 10,000 psi. All ranges and sub-ranges (including endpoints) between about 500 psi and about 10,000 psi are considered explicitly disclosed herein.

These and other features of the systems and processes of the present disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain systems may be devoid of filters.

BRIEF DESCRIPTION OF THE DRAWINGS

The manner in which the objectives of this disclosure and other desirable characteristics can be obtained is explained in the following description and attached drawings in which:

FIG. 3 is a schematic screenshot of a $sCO_2$ circulation thermal analysis tool Input Panel;

FIGS. 6A and 6B are schematic screenshot and graphs, respectively, presenting data of the embodiment of FIG. 5;

Figure 9:
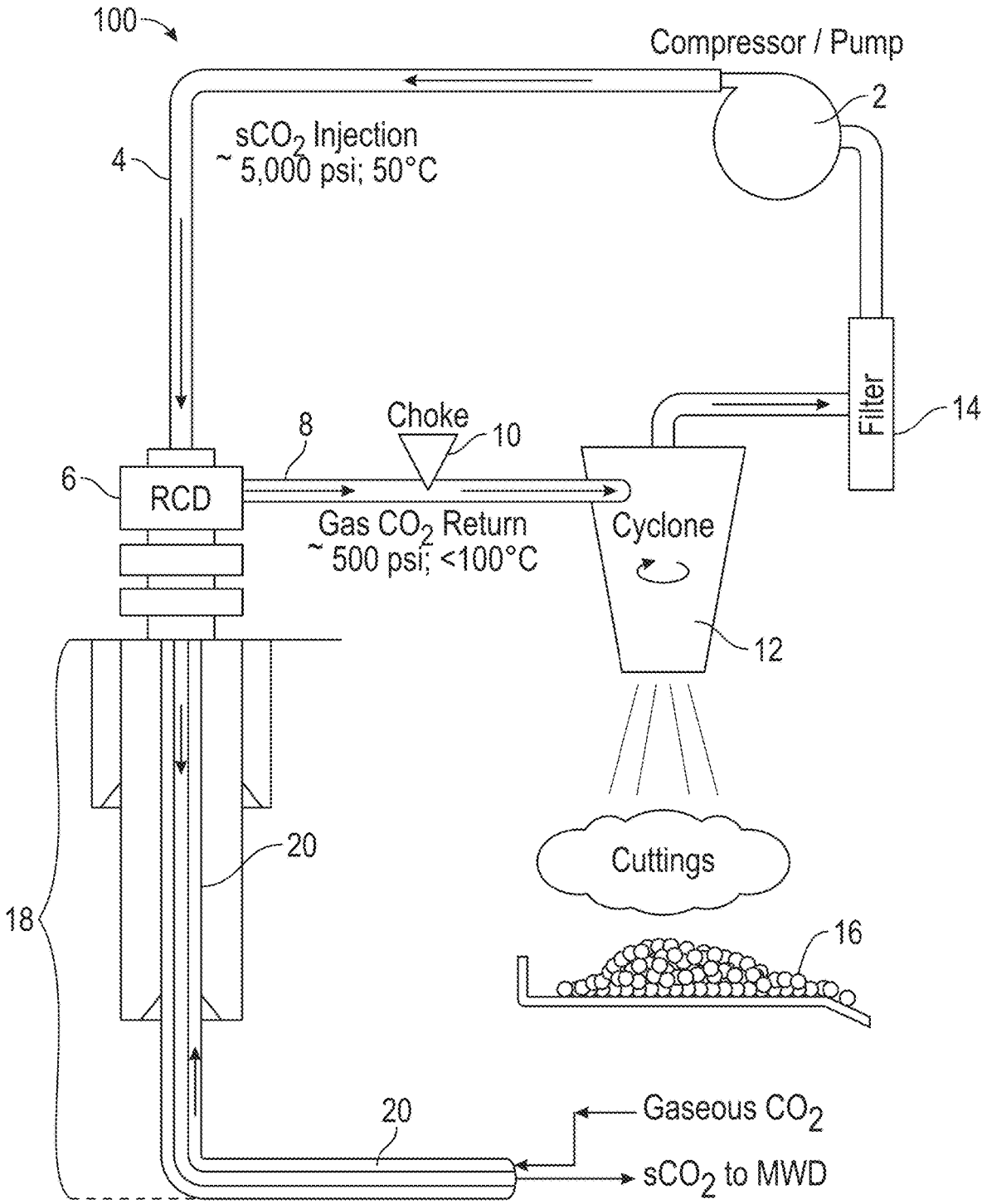
FIG. 9 is a schematic illustration of a closed-loop $CO_2$ recycle system in accordance with one embodiment of the present disclosure.

It is to be noted, however, that the appended drawings are not to scale, and illustrate only typical system embodiments of this disclosure. Furthermore, FIG. 9 schematically illustrates only one of many possible closed-loop recycle systems and processes of this disclosure. Therefore, the drawing figures are not to be considered limiting in scope, for the disclosure may admit to other equally effective embodiments. Identical reference numerals are used throughout the several views for like or similar elements.

DETAILED DESCRIPTION

In the following description, numerous details are set forth to provide an understanding of the disclosed apparatus, combinations, and processes. However, it will be understood by those skilled in the art that the apparatus, systems, and processes disclosed herein may be practiced without these details and that numerous variations or modifications from the described embodiments may be possible. All technical articles, published and non-published patent applications, standards, patents, statutes and regulations referenced herein are hereby explicitly incorporated herein by reference, irrespective of the page, paragraph, or section in which they are referenced. Where a range of values describes a parameter, all sub-ranges, point values and endpoints within that range or defining a range are explicitly disclosed herein. All percentages herein are by weight unless otherwise noted. In the event definitions of terms in the referenced patents and applications conflict with how those terms are defined in the present application, the definitions for those terms that are provided in the present application shall be deemed controlling. Where a range of values describes a parameter, all sub-ranges, point values and endpoints within that range are explicitly disclosed herein. This document follows the well-established principle that the words "a" and "an" mean "one or more" unless we evince a clear intent to limit "a" or "an" to "one." For example, when we state "flowing $sCO_2$ into a surface inlet of a drillstring positioned inside a casing of a well", we mean that the specification supports a legal construction of "a drillstring" that encompasses structure distributed among multiple physical structures, and a legal construction of "a well" that encompasses structure distributed among multiple physical structures.

As mentioned herein, Extraction of heat from Dry Hot Rock (DHR) presents several efficiency and power advantages over other EGS or CLGS approaches for geothermal energy recovery. To efficiently extract DHR heat, horizontal wells are drilled within the resource. However, DHR temperatures (>350° C.) are too high for the use of MWD or directional tools. At current state-of-the-art, MWD and directional tools are limited to about 150° C. (limiting the maximum resource temperature to ~200° C.). This restricts DHR drilling to vertical or uncontrolled deviated wells, with single shot surveys to guide directional control. In DHR wells where well trajectory control is critical to connect injector and producer fractures, this can pose a significant problem. As may be seen, current practices may not be adequate for all circumstances, and do not address problems with respect to MWD components and methods when drilling in DHR. There remains a need for more robust DHR drilling systems and processes. The systems and processes of the present disclosure are directed to these needs.

Supercritical $CO_2$

Figure 1:
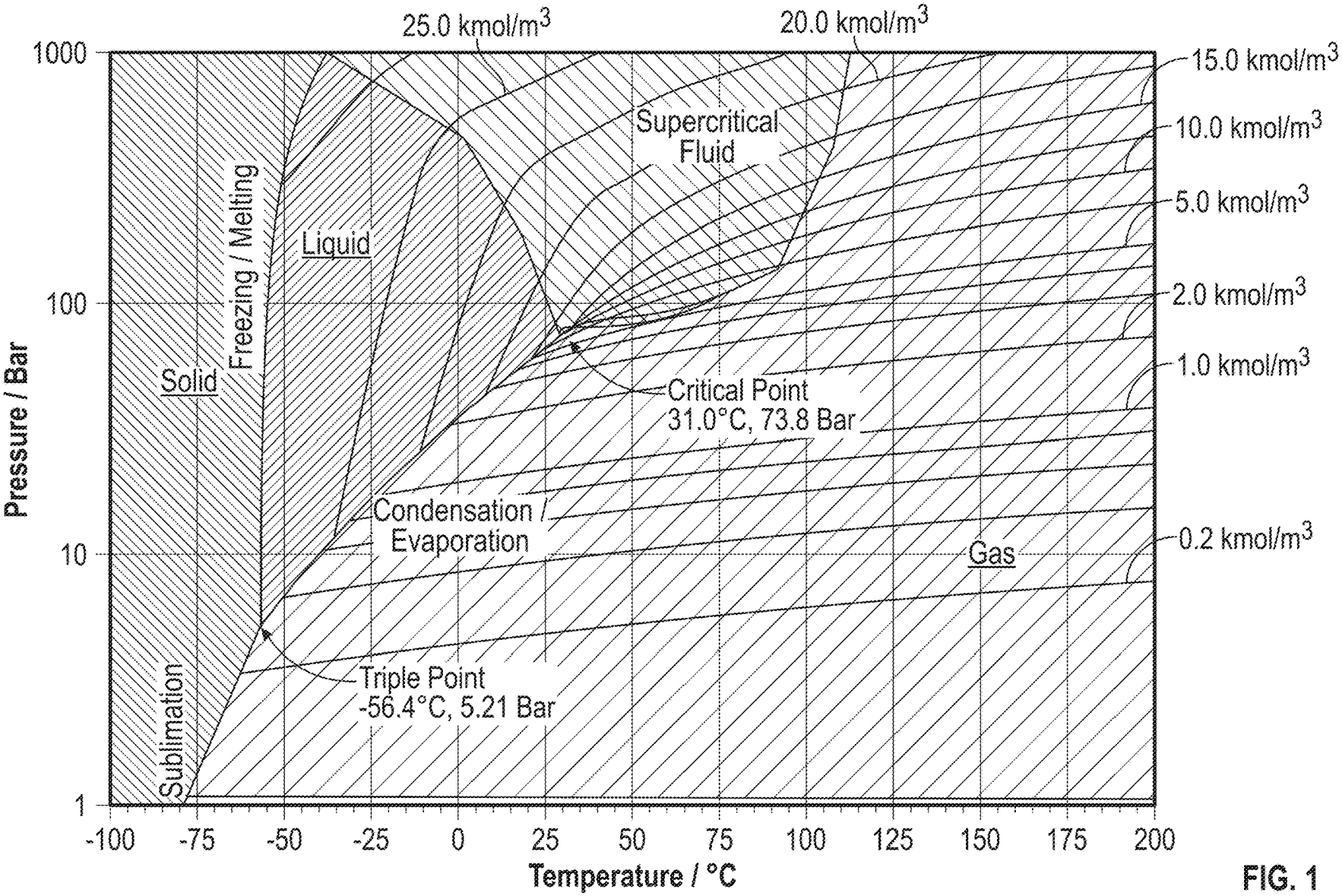
FIG. 1 is a schematic pressure vs. temperature diagram for carbon dioxide.
Figure 2:
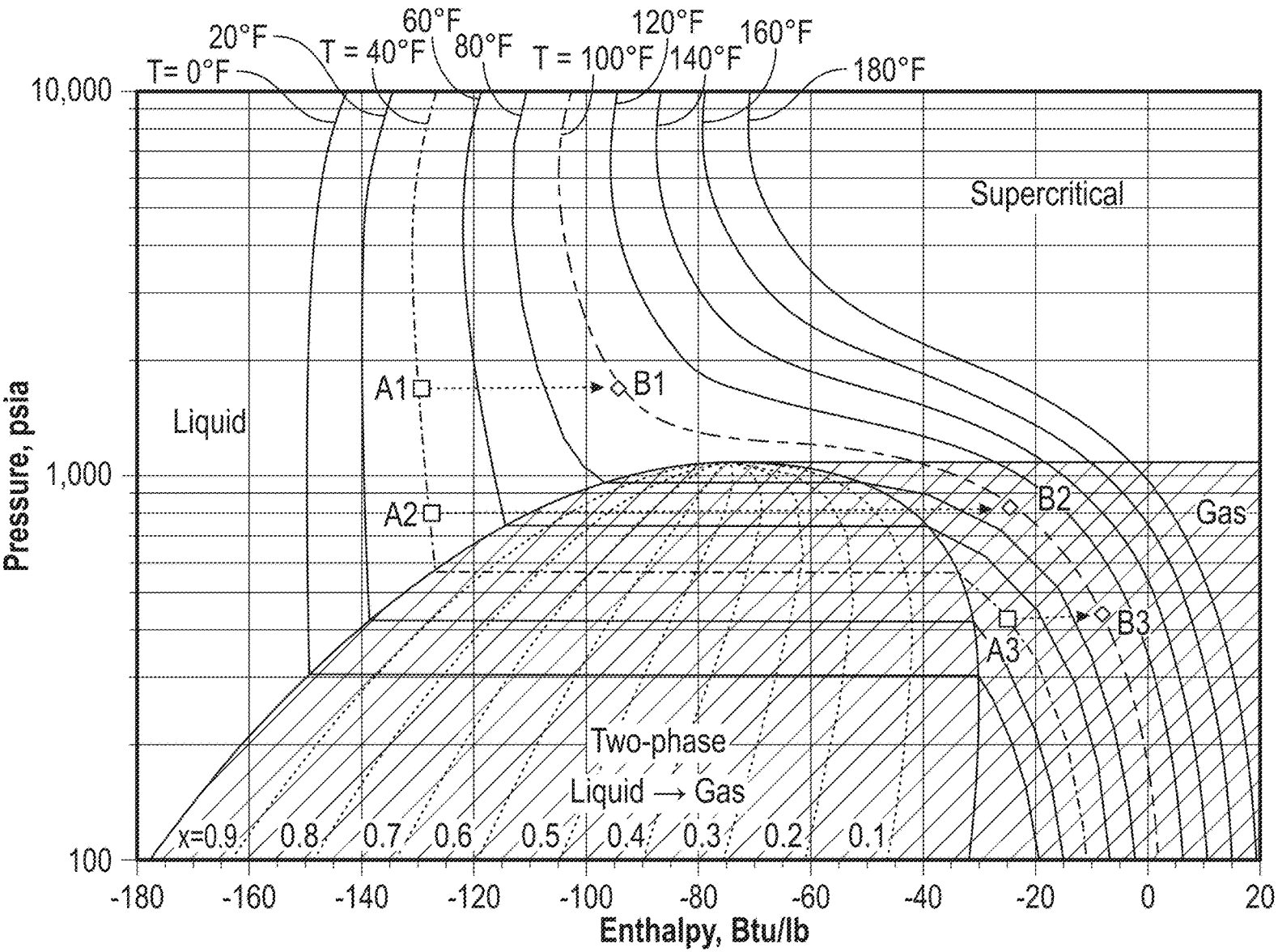
FIG. 2 is a schematic pressure vs. enthalpy diagram for carbon dioxide.

Supercritical $CO_2$ ($sCO_2$) or dense phase $CO_2$ offers the potential for management of MWD temperature. As illustrated in FIGS. 1 and 2, carbon dioxide becomes supercritical above 31° C. and 74 bar (1,073 psi). This property results in some advantages:

- $CO_2$ is a familiar fluid with extensive industrial uses;
- positive Joule-Thomson coefficient and phase change allows for reduction of temperature with drop in pressure;
- low viscosity, reducing pump pressure required;
- high density, allowing the use of mud-pulse telemetry;
- supercritical in drillpipe upstream of MWD for telemetry;
- gaseous in annulus, further reduction in heat transfer.

Challenges of working with $CO_2$ include it's low specific heat, handling and processing in a closed loop system, and other operational considerations.

As described in more detail herein with reference to the various drawing figures, systems and processes of the present disclosure address problems identified by the inventors herein, namely the unknown feasibility and effectiveness of using $sCO_2$ in dry hot rock drilling to achieve lower temperatures for MWD operability. The inventors herein investigated use of downhole drillpipe choke(s) to create a pressure drop across MWD or directional tools to cool down drilling fluid below 150° C. In certain embodiments conditions in the annulus are managed to create gaseous phase $CO_2$ in the annulus. In certain embodiments the surface annulus return temperature is maintained below 100° C. (for ease of handling and RCD and/or NRCD operability). In certain embodiments, the temperature across the MWD components being less than 150° C. and the temperature in the annulus at the surface being less than 100° C. are achieved within constraints of pump pressure and required flow rate to transport cuttings to surface.

Modeling Methods

The inventors herein have developed a custom Microsoft® Excel®-based program to model the problem.

Model Method Inputs

- Transient Pressure-Enthalpy formulation;
- Built-in REFPROP (from NIST) module to obtain thermodynamic properties of fluids and their mixtures.

In certain embodiments the modeling methods may comprise inputting (as shown in the screenshot of a thermal analysis input panel in FIG. 3):

- Drilling Fluid type;
- Mass Flow Rate (kg/s);
- Annulus Return Pressure (psi);
- Inlet Temperature) (° ° C.);
- Hole Length (m);
- Chokes: Depth (m) and diameter (mm);
- MWD Depth (m);
- Bit nozzles number and diameter (1/32 in.);
- Drill pipe, casing and hole data;
- Formation properties.

Additionally, the models can handle both $CO_2$ and water, and can be extended to include facilities.

Modeling Method Outputs

- Outputs of plots for temperature, pressure, and specific enthalpy along depth;
- State diagram (pressure-enthalpy) showing state path of fluid in drill pipe and annulus;
- Temperatures at MWD, drill bit and surface returns;
- Pressures at standpipe, MWD and drill bit (surface back pressure is given, and a parameter of the problem);
- Annular velocity of fluid in annulus.

Figure 4:
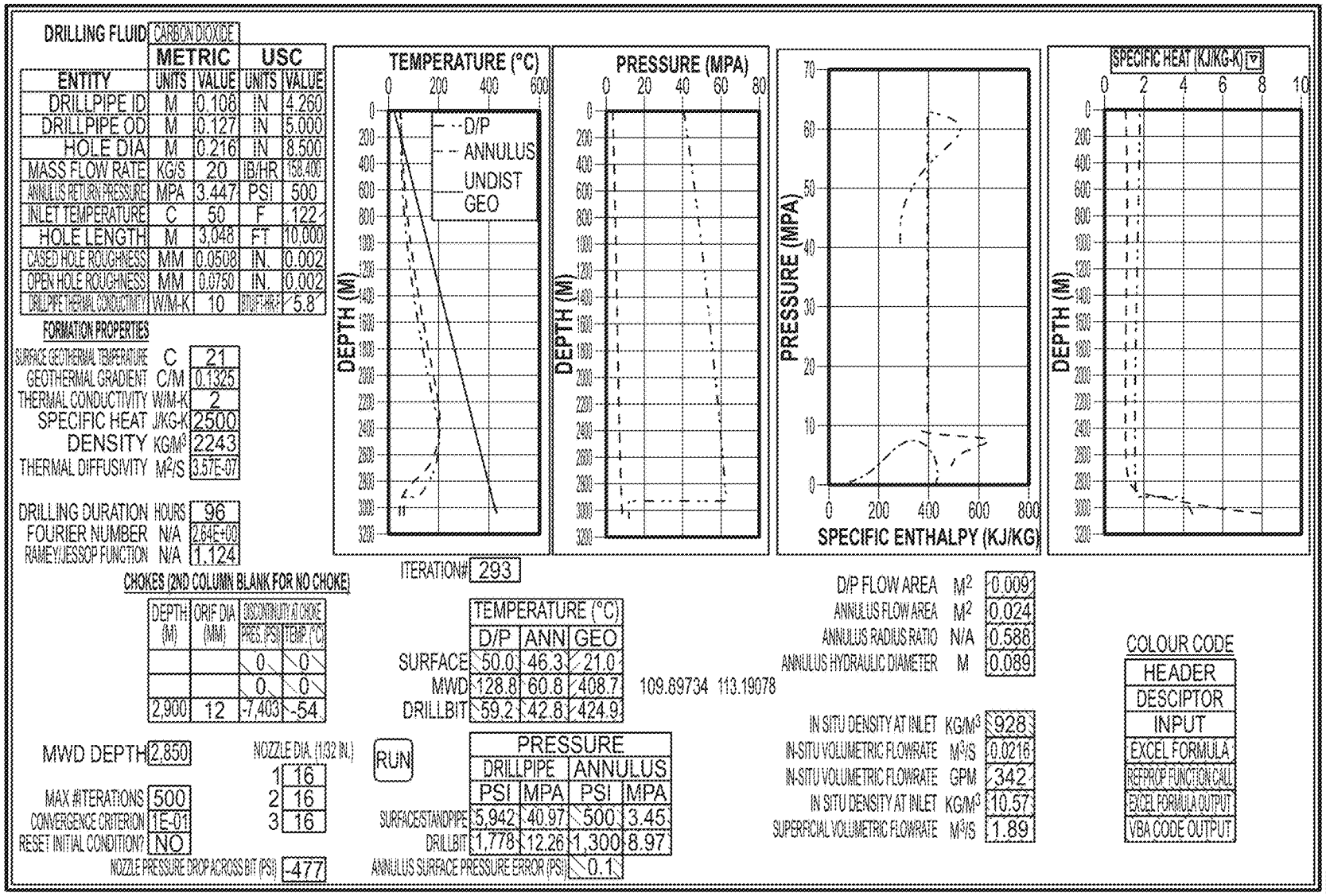
FIG. 4 is a schematic screenshot of a $sCO_2$ thermal-hydraulic model.

In certain embodiments, such as illustrated schematically in the screenshot presented in FIG. 4, the modeling method outputs may include:

- Return Annulus Surface Temperature (° C.);
- Temperature at MWD location (° C.);
- Fluid Temperature above bit (° C.);
- Pump/Standpipe Pressure (psi);
- Fluid Pressure above bit (psi);
- Minimum Annular Velocity (m/s);
- Density at MWD ($kg/m^3$);
- Plus various graphical displays of pressure and temperature profiles, state curve in p-H diagram, profiles of other properties (density, specific heat, and the like).

Example Well Case Study

- Well Geometry:
  - Vertical well with TD of 10,000 ft
  - Linear undisturbed geothermal temperature profile with temperature of 400° C. at well total depth
  - 9,000 ft of 9⅝ in. casing
  - 1,000 ft of 8½ in. hole
  - 5 in. drill pipe (ID: 4.260 in.)
  - MWD location is assumed at 2,850 m (9,350 ft)
  - A bit has been included in the BHA and has a TFA of 0.589 $in^2$
- Operational Design Factors:
  - sCO2 injection parameters: pressure is calculated, temperature is input (sensitivity parameter)
  - Back pressure, number, location and diameters of chokes are inputs (sensitivity parameters)
  - Target Temperature at MWD is 150° C.

Target density at MWD>0.7 SG

Return Annulus Temperature must be <100° C.

Operationally, 5,000 psi pump pressure rating is typical for land rigs. Offshore rigs are typically equipped with 7,500 psi pump rating. To operate above 7,500 psi pump pressure range, certain embodiments may include specialized equipment, such as high pressure pumps, coiled tubing rigs, and combinations thereof. Standpipe pressure (SPP) above 15,000 psi is considered extreme. For this case study, we notionally target between 5,000 psi and 7,500 psi standpipe pressure.

Another operational consideration for this example was annular velocity, which is responsible for cuttings transport in non-viscosified circulating media. Empirical rules of thumb for vertical wells are as follows:

Clear liquids: 180 ft/min (55 m/min or 0.92 m/s);

Annular mist: 1500 ft/min (460 m/min or 7.62 m/s);

Dry gas: 3000 ft/min (920 m/min or 15.24 m/s).

We surmised that $CO_2$ in the annulus likely will change phase during its return flow, going from dense phase to gaseous phase, therefore, minimum annular velocity required may be a function of depth. Hole cleaning requirements have not yet been established for such fluids. For this Example Well Case Study, we assumed an annular velocity of about 1-3 m/s in dense phase, and >7 m/s in the high-pressure gaseous phase. These assumptions were arbitrary, and further work is required to quantify them, especially for deviated and horizontal wells. Table 1 provides addition data for this Example. Cases Reported: 42; annulus return pressure for all cases: 500 psi

TABLE 1

Flow Rate, Choke Diameter, and Inlet Temperature

| Entity | Minimum | Base | Maximum |
|---|---|---|---|
| Flow rate, kg/s (gpm) | 5 (80) | 20 (318) | 60 (955) |
| Choke diameter, mm | 6 | 10 | 12 |
| Inlet temperature, ° C. | 50 | 75 | 100 |

Figure 5:
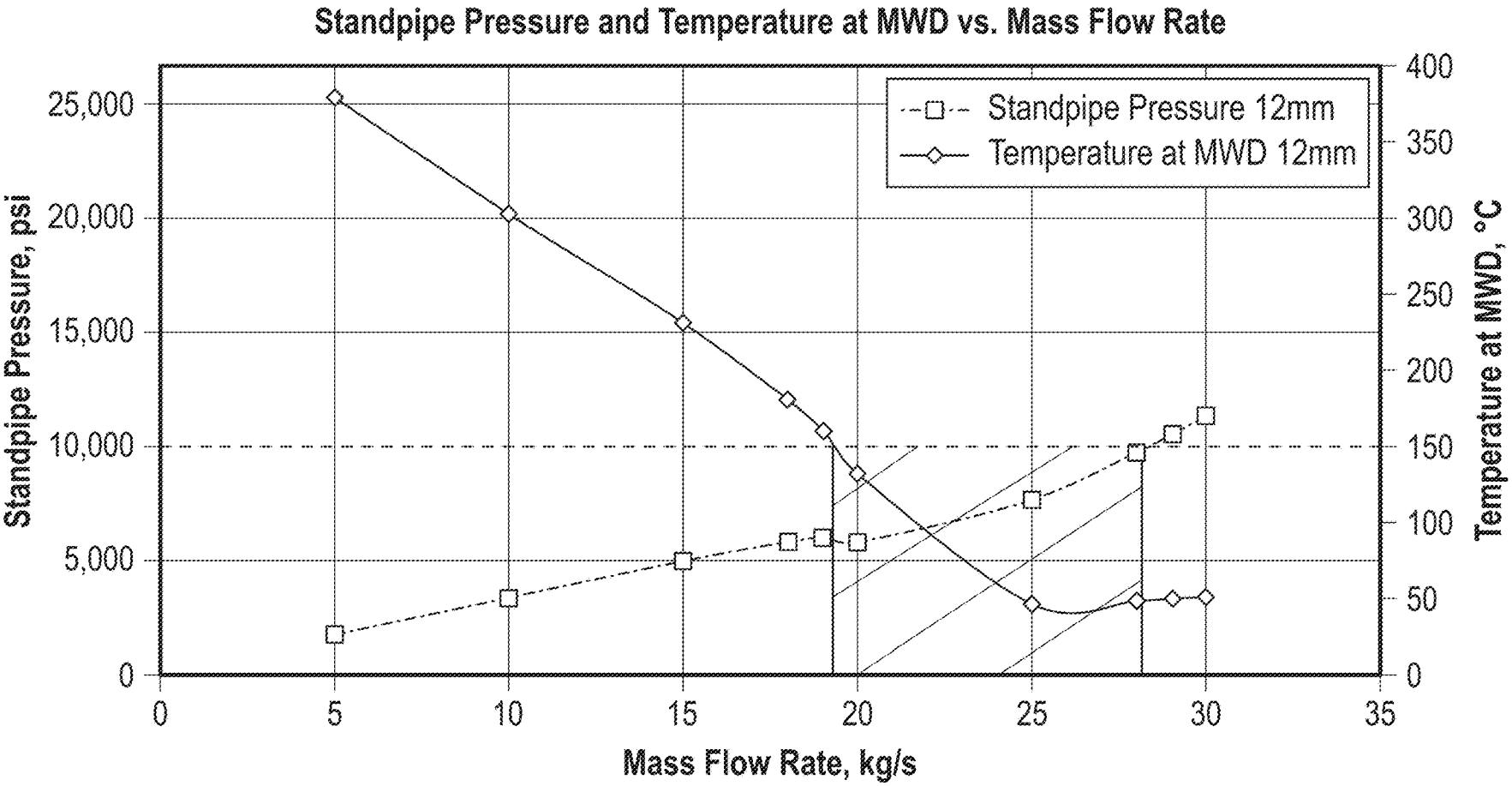
FIG. 5 is a graph of standpipe pressure and temperature at MWD vs. mass flow rate of $sCO_2$ for one embodiment using a 12 mm choke diameter.
Figure 6B:
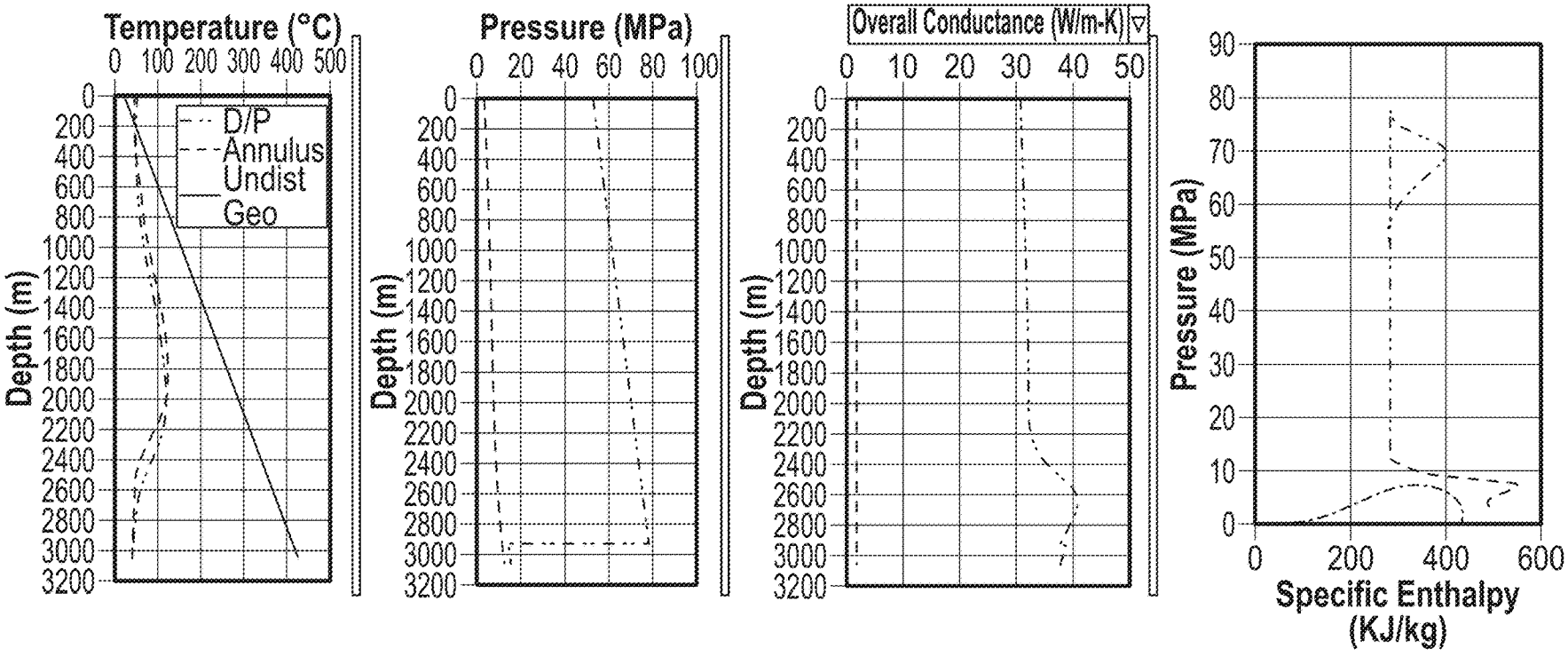
Figure 7:
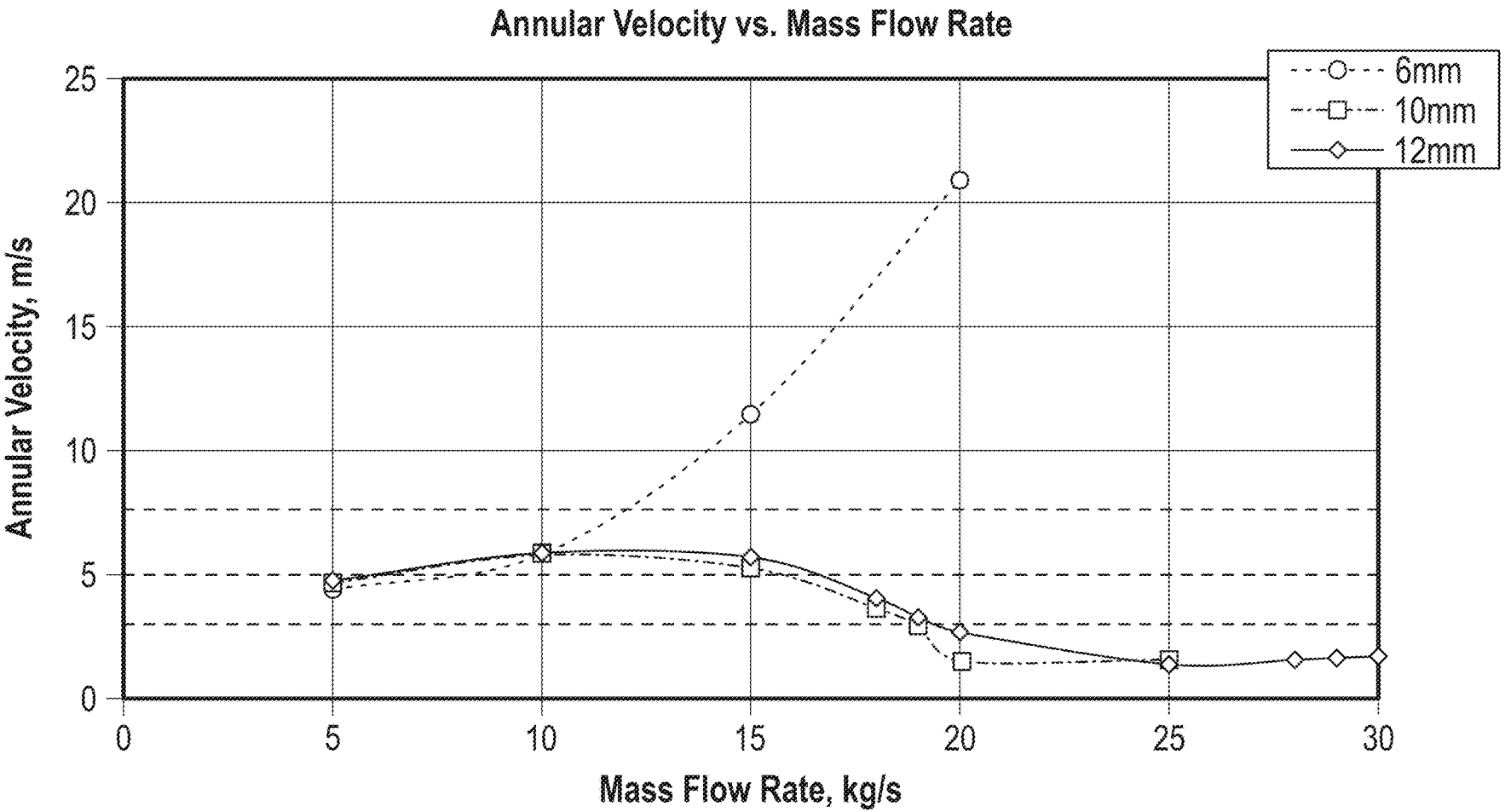
FIG. 7 is a graph of annular velocity vs. mass flow rate for three different choke diameters.
Figure 8:
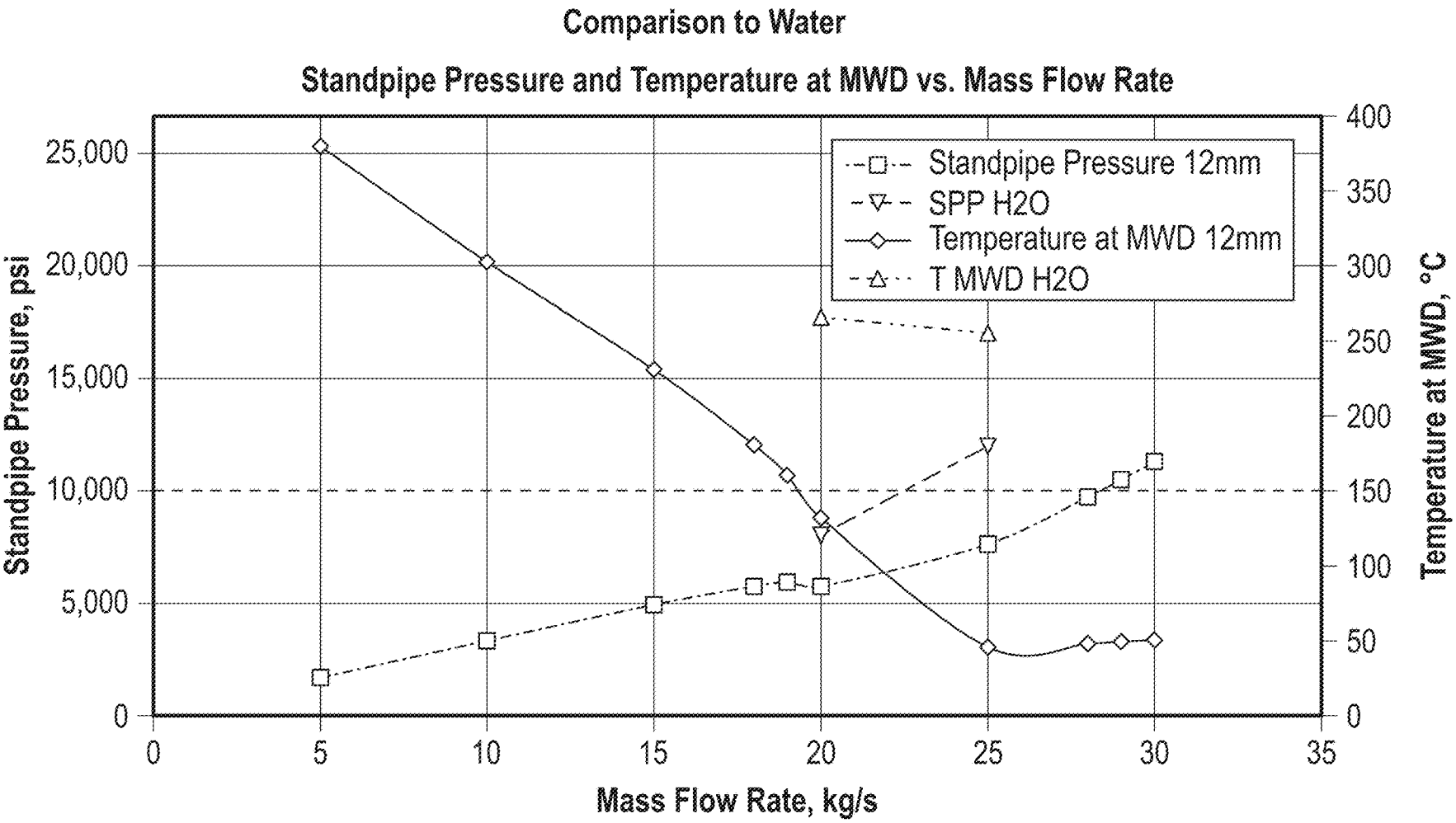
FIG. 8 graphically compares water and $sCO_2$ standpipe pressure and temperature at MWD vs. mass flow rate for one embodiment using a 12 mm choke diameter.

FIG. 5 is a graph of standpipe pressure and temperature at MWD vs. mass flow rate of $sCO_2$ for one embodiment using a 12 mm choke diameter. Within the range of 19 kg/s to 25 kg/s, there is a distinct operating window. Further embodiments may have different choke location, different choke diameter, no choke options, and reduced annulus return pressure at wellhead. FIGS. 6A and 6B are schematic screenshot and graphs, respectively, presenting data of the embodiment using 12 mm diameter choke. Note from FIG. 6B, supercritical conditions existed in the drillpipe and a portion of the annulus. FIG. 7 is a graph of annular velocity vs. mass flow rate for the three different choke diameters of this Example, illustrating that minimum annular velocity was in the range of 1-2 m/s, occurring deep in the well in dense phase region. FIG. 8 graphically compares water and $CO_2$ standpipe pressure and temperature at MWD vs. mass flow rate for one embodiment using a 12 mm choke diameter, illustrating that for the same flow rates, drilling with water results in much higher temperatures at the MWD: for sCO2: 150° C. to 50° C.; for water: 260° C. to 250° C.

In certain embodiments it may be possible to eliminate downhole chokes by managing phase change location downhole. This may be modeled. Other embodiments may comprise hole cleaning using $sCO_2$, and modeling same. Further numerical and experimental work to establish annular velocities for adequate hole cleaning using $sCO_2$ are contemplated.

FIG. 9 is a schematic illustration of a closed-loop $CO_2$ recycle system in accordance with one embodiment 100 of the present disclosure. In this embodiment, inlet side with $CO_2$ compressor and $sCO_2$ pump 2 (both are commercially available) may produce the following:

Inlet rate of sCO2 in conduit 4 flowing through rotating control device (RCD) 6, 20-25 kg/s (300-400 gpm);

Pressure 5,000-7,500 psi.

The return pressure of gaseous $CO_2$ from the annulus 20 of well 18 at RCD 6 and return conduit 8 is expected to be 500 psi or lower, gaseous $CO_2$.

Closed loop system to recycle $CO_2$ embodiment 100 may comprise:

a choke 10 in return conduit 8 to manage system pressure;

one or more cyclone separators 12 and filters 14 to remove drill solids (cuttings 16);

optionally one or more $CO_2$ dehydrators (not illustrated) if water influx.

Other embodiments than that presented schematically in FIG. 9 are contemplated and considered within the present disclosure.

Control devices may comprise a combination of: one or more pressure control devices, also referred to as chokes; one or more temperature control devices; one or more $sCO_2$ pumping devices; one or more flow measurement devices (also referred to herein as mass flow meters or mass flow sensors); and in certain embodiments one or more accessory equipment such as one or more connectors, one or more isolation valves, one or more pressure relief devices, among others. The specific configuration of the well, drillstring, and closed-loop recycle system define the capabilities of each system and process embodiment. Redundancy of components may allow for extended service periods and mitigates risk of downtime due to component failure. An example would be a pressure control device (choke) plugging with drilled cuttings, or washout due to erosion. In this case, isolating the failed component and enabling another one allows for continued operations, and enables evaluation and/or modification of the operational parameters to minimize the risk of failure of the new component in use.

Furthermore, certain systems and processes of the present disclosure may be designed to be installed in such a way that components may be retrieved from subsea to the surface, by using remotely operated vehicle (ROV) friendly quick connectors (or other means). These embodiments allow servicing components subject to potential failure during operations or in between hole sections, without the need to pull the riser to service components. These embodiments are particularly practical for servicing pressure control devices (or chokes), which may be subject to plugging or washouts.

Systems and processes of the present disclosure may be operated using hydraulic and/or electric power. One possible configuration is full electric power to operate the $CO_2$ compressor and $sCO_2$ pump; other embodiments may employ hydraulic power to operate these units. In certain embodiments, both electric and hydraulic power supply may have redundant and/or back up power supply. In certain embodiments, hydraulic power may require installation of an additional hydraulic unit on the drilling rig, possibly including storage for pressurized fluid for backup power. In certain embodiments, the drilling unit's electric generators may provide electric power, and backup power may be provided by an uninterruptible power supply (UPS) battery system.

In certain embodiments, the $CO_2$ compressor, $sCO_2$ pump, and other components may be stored on the drilling unit/floating vessel on the riser deck, on a dedicated crate fabricated for this purpose.

With respect to data connection/integration, in certain embodiments control signals for the components of the systems of the present disclosure, as well as parameters measured or captured by the system's sensors (e.g., pressures, temperatures, fluid flow rates and density, position indicators, etc.) may be transmitted to and from the drilling unit/floating vessel from and to the closed-loop $CO_2$ recycle system, and to chokes or other MWD cooling devices downhole. In certain subsea embodiments, umbilical control lines may provide the means for this data transmission. On the drilling unit/floating vessel, the data may be integrated at different levels, potentially with different control systems. Examples of control systems which can potentially integrate data to and from the systems of the present disclosure include control systems for MPD (installed ad hoc for MPD operations), mud logging, drawworks, top drive, rotary table, pipe handling, and the like. In certain embodiments, data integration may require running cables between different locations on the drilling unit/floating vessel. Industry standards, operator requirements, and/or local laws may dictate cable routing configurations.

Flow control devices are key components of drilling systems and processes. One or more flow control devices enables sealing and pressure containment between the drill pipe and $CO_2$ systems, while allowing the drill pipe to rotate and reciprocate without losing seal integrity. Flow control devices may be rotating flow control devices (RCD) or non-rotating flow control devices (NRCD), or combination thereof (for example, one RCD and one NRCD positioned in series). Several OEMs manufacture and provide flow control devices to the industry. Any known type of flow control device may be employed in practicing the systems and processes of the present disclosure. Suitable flow control devices and components typically used therewith include those currently commercially available from Weatherford International, Schlumberger, and NOV-AFGlobal.

A well returns conduit directs the wells returns (comprising cuttings, $CO_2$, and some hydrocarbons, and drilling fluid) back to the surface, or for offshore embodiments, ultimately to the drilling unit on surface floating vessel or other service vessel for processing and recirculation.

One or more operational pressure control devices may enable accurate control of the pressure profile in the well, by manipulating restriction to the flow returns from the well. As pressure control devices may be prone to plugging or washing out under certain operational conditions, redundancy can provide means to continue operations should this deviation occur, or to maintain pressure control while addressing the causes, if possible. Adequate number and sizing of the pressure control device(s) may enable accurate pressure control for ample ranges of flow rates, by using more than one valve (and/or a larger size valve) for high flow conditions. Pressure control devices may be designed for remote operation from the drilling unit. Some examples are manual pressure control, semi-automated pressure control (i.e., pressure set point control at the valve location), or fully automated downhole pressure control, which typically involves a hydraulic model calculating in real time the required choke pressure set point for the desired downhole conditions.

A dedicated contingency pressure control device may be used to quickly react to sudden increases in pressure, potentially due to one or more operational pressure control devices plugging with drilled cuttings, or other reasons. This contingency pressure control device may be controlled by an automated system to open and regulate a maximum pressure set point providing time to enable additional flow paths to bypass the blocked component, if available, or to stop operations to correct the deviation.

A mass flow meter may enable monitoring the pressure on the returns side, and may provide early kick and loss detection by comparison of fluid flow and density out of the well against fluid flow and density being pumped into the well.

During operation, one or all of T, P, mass flow rate, gas or vapor concentrations (or percentages of set point values) inside and/or outside the drillstring and in the annulus may be displayed locally on Human Machine Interface (HMI), such as a laptop computer having display screen having a graphical user interface (GUI), or handheld device, or similar. In certain embodiments the HMI may record and/or transmit the data via wired or wireless communication to another HMI, such as a laptop, desktop, or hand-held computer or display. These communication links may be wired or wireless.

One or more control strategies may be employed. A pressure process control scheme may be employed, for example in conjunction with the pressure control devices and mass flow controllers. A master controller may be employed, but the disclosure is not so limited, as any combination of controllers could be used. Programmable logic controllers (PLCs) may be used.

Control strategies may be selected from proportional-integral (PI), proportional-integral-derivative (PID) (including any known or reasonably foreseeable variations of these), and may compute a residual equal to a difference between a measured value and a set point to produce an output to one or more control elements. The controller may compute the residual continuously or non-continuously. Other possible implementations of the disclosure are those wherein the controller comprises more specialized control strategies, such as strategies selected from feed forward, cascade control, internal feedback loops, model predictive control, neural networks, and Kalman filtering techniques.

Closed loop recycle systems and other components described herein may be built to meet ISO standards, Det Norske Veritas (DNV) standards, American Bureau of Standards (ABS) standards, American Petroleum Institute (API) standards, and/or other standards.

The electrical connections, if used (voltage and amperage) will be appropriate for the zone rating desired of the system. In certain embodiments one or more electrical cables may be run and connected to an identified power supply at the work site to operate the HMI, $CO_2$ recycle system, and other components. Certain embodiments may employ a dedicated power supply. The identified or dedicated power supply may be controlled by one or more logic devices so that it may be shut down. In exemplary embodiments, systems of the present disclosure may have an electrical isolation (lockout) device on a secure cabinet.

In certain embodiments, internal algorithms in the logic device, such as a PLC, may calculate a rate of increase or decrease in pressure inside the drillpipe and/or annulus, and/or in the $CO_2$ recycle system. This may then be displayed or audioed in a series of ways such as "percentage to shutdown" lights or sounds, and the like on one or more GUIs. In certain embodiments, an additional function within a HMI may be to audibly alarm when the calculated pressure rate of increase or decrease reaches a level set by the operator. In certain embodiments this alarm may be sounded at the well site, as well as remote from the well site, for example in a shipboard control room, or remote control room.

What has not been recognized or realized are systems and processes for well trajectory control in DHR wells to connect injector and producer fractures that are robust and safe. What also has not been recognized or realized are methods of modeling use of $sCO_2$ in drilling a well in dry hot rock using a drillstring having a drill bit and one or more MWD components. Systems and processes to accomplish this without significant risk to workers is highly desirable. As explained previously, systems and processes have been proposed by others to deal with the problem of protecting MWD components while drilling in hot dry rock formations (vacuum insulated piping; more robust MWD components), but they are not necessarily economical or even available. The present inventors, however, personally know of the inefficiencies of such practices.

Thus the systems, processes, and modeling methods described herein afford ways to perform hot dry rock drilling efficiently, safely and economically, and with significantly reduced risk of injury and discomfort to rig workers.

From the foregoing detailed description of specific embodiments, it should be apparent that patentable systems, processes, and modeling methods have been described. Although specific embodiments of the disclosure have been described herein in some detail, this has been done solely for the purposes of describing various features and aspects of the systems and processes, and is not intended to be limiting with respect to their scope. It is contemplated that various substitutions, alterations, and/or modifications, including but not limited to those implementation variations which may have been suggested herein, may be made to the described embodiments without departing from the scope of the appended claims. For example, some systems of this disclosure may be devoid of certain components and/or features: for example, systems devoid of cyclone separators, or devoid of filters; systems devoid of low-strength steels; systems devoid of threaded fittings; systems devoid of welded fittings; systems devoid of casing.

What is claimed is:

1. A system for well trajectory control in dry hot rock (DHR) wells to connect injector and producer fractures comprising:

(a) a cased portion of a well configured to accept a drillstring, the drillstring comprising a surface inlet;

(b) a closed-loop $CO_2$ recycle system comprising (i) a well returns conduit, (ii) a $CO_2$ compressor, (iii) a supercritical $CO_2$ pump, the $CO_2$ compressor configured to produce supercritical $CO_2$ ($sCO_2$) and deliver it via the supercritical $CO_2$ pump and a supply conduit to the surface inlet at a rate ranging from about 20 to about 25 kg/s (about 300 to about 400 gpm) at a pressure ranging from about 5,000 to about 7,500 psi, and the $CO_2$ compressor configured to accept a return $CO_2$ gas composition at a return pressure of at most 500 psi;

(iv) one or more pressure control devices to manage pressure of the closed-loop $CO_2$ recycle system;

(v) one or more gas/solid separators receiving well returns through the well returns conduit, the one or more gas/solid separators configured to remove a major portion of drill cuttings and solids fines from the well returns and produce the return $CO_2$ gas composition;

(c) the drillstring comprising at least one measurement-while-drilling (MWD) component protected from malfunctioning by a cooling device, the cooling device configured to accept $sCO_2$ and expel non-critical $CO_2$ adjacent or nearly adjacent the at least one MWD component, thereby cooling the at least one MWD component by Joule-Thomson effect cooling.

2. The system of claim 1 wherein the one or more pressure control devices comprises one or more chokes.

3. The system of claim 1 wherein the one or more gas/solid separators is selected from one or more cyclones, one or more filters, and combinations of these.

4. The system of claim 1 wherein the cooling device is selected from a pressure letdown valve, a choke, and a Joule-Thomson valve.

5. The system of claim 1 wherein the at least one MWD component is selected from one or more temperature measurement devices, one or more pressure measurement devices, one or more density measurement devices, one or more mass flow measurement devices, one or more volume flow measurement devices, one or more radiation measurement devices, one or more gyroscopes, one or more magnetometers, one or more accelerometers, and combinations of two or more of these.

6. The system of claim 1 wherein the at least one MWD component is selected from one or more gyroscopes, one or more magnetometers, one or more accelerometers, and combinations of two or more of these.

7. A process for well trajectory control in DHR wells to connect injector and producer fractures, comprising:

(a) inserting a drillstring comprising at least one measurement-while-drilling (MWD) component into a cased portion of a well, the drillstring comprising a surface inlet, the drillstring and cased portion of the well defining a first portion of an annulus;

(b) drilling a borehole with the drillstring while trajectory controlling a drill bit attached to a distal end of the drillstring using at least one of the MWD components, the drillstring and borehole wall defining a second portion of the annulus;

(c) pumping supercritical $CO_2$ ($sCO_2$) into the surface inlet at a rate ranging from about 20 to about 25 kg/s (about 300 to about 400 gpm) at a pressure ranging from about 5,000 to about 7,500 psi;

(d) routing at least some of the sCO2 through a cooling device positioned adjacent or sufficiently adjacent the at least one MWD component, cooling the at least one MWD component by Joule-Thomson effect cooling, thereby protecting the at least one MWD component from malfunctioning, the cooling device expelling non-critical $CO_2$ into the second portion of the annulus;

(d) routing well returns comprising the non-critical $CO_2$ through the first and second portions of the annulus to a well returns conduit;

(e) routing the wells returns to a $CO_2$ compressor of a closed-loop $CO_2$ recycle system, producing the $sCO_2$, the $CO_2$ compressor accepting a return $CO_2$ gas composition at a return pressure of at most 500 psi;

(f) routing the $sCO_2$ to a supercritical $CO_2$ pump, the supercritical $CO_2$ pump delivering the $sCO_2$ to the surface inlet;

(g) controlling pressure in the first and second portions of the annulus and in the closed-loop $CO_2$ recycle system using one or more pressure control devices;

(h) removing a major portion of drill cuttings and solids fines from the well returns using one or more gas/solid separators receiving the well returns through the well returns conduit, the one or more gas/solid separators producing the return $CO_2$ gas composition.

8. The process of claim 7 wherein the controlling of the pressure in the first and second portions of the annulus and in the closed-loop $CO_2$ recycle system comprises operating one or more chokes.

9. The process of claim 7 wherein the removing of the major portion of the drill cuttings and solids fines from the well returns comprises routing the well returns to one or more cyclones, one or more filters, and combinations of these.

10. The process of claim 7 wherein the cooling of the at least one MWD component by Joule-Thomson effect cooling comprises routing the $sCO_2$ through a pressure letdown valve, a choke, or a Joule-Thomson valve.

11. The process of claim 7 wherein the at least one MWD component is selected from one or more temperature measurement devices, one or more pressure measurement devices, one or more density measurement devices, one or more mass flow measurement devices, one or more volume flow measurement devices, one or more radiation measurement devices, one or more gyroscopes, one or more magnetometers, one or more accelerometers, and combinations of two or more of these.

12. The process of claim 7 wherein the at least one MWD component is selected from one or more gyroscopes, one or more magnetometers, one or more accelerometers, and combinations of two or more of these.

* * * * *